United States Patent [19]

Miles, Jr.

[11] 3,974,371

[45] Aug. 10, 1976

[54] ADJUSTABLE LIGHT FIXTURE

[75] Inventor: Earl F. Miles, Jr., Indianapolis, Ind.

[73] Assignee: Indy Lighting, Inc., Indianapolis, Ind.

[22] Filed: June 9, 1975

[21] Appl. No.: 585,121

[52] U.S. Cl. ..... 240/73 BJ; 240/41.6; 240/61.11; 240/78 HA

[51] Int. Cl.[2] ..... F21S 1/00

[58] Field of Search ..... 240/78 R, 78 HA, 78 H, 240/78 B, 61.11, 61.12, 61.13, 41.6, 41.61, 41.62, 73 BJ

[56] References Cited

UNITED STATES PATENTS

| | | | |
|---|---|---|---|
| 2,782,295 | 2/1951 | Schwenkler | 240/61.12 X |
| 2,826,684 | 3/1958 | Baker | 240/78 H |
| 2,855,503 | 10/1958 | Gerstel | 240/41.6 X |
| 3,660,651 | 5/1972 | Miles, Jr. | 240/61.11 X |
| 3,778,609 | 12/1973 | Liberman | 240/78 HA |

*Primary Examiner*—L. T. Hix
*Assistant Examiner*—E. M. O'Connor
*Attorney, Agent, or Firm*—Woodard, Weikart, Emhardt & Naughton

[57] ABSTRACT

An adjustable light fixture recessible in a ceiling for directing light toward an object at various angles. A shade having an incandescent or mercury light element is suspended within a housing by a pair of multi-membered arms. Both arms are adjustable for moving the shade vertically. The shade is rotatably mounted to a yoke for allowing the shade and bulb to pivot about the horizontal mounting axis. The yoke is rotatably mounted to a U-shaped bracket fastened to the pair of arms allowing the shade and bulb to rotate about a vertical axis. Stops are provided to prevent tangling of the electrical wires.

5 Claims, 7 Drawing Figures

ADJUSTABLE LIGHT FIXTURE

BACKGROUND OF THE INVENTION

1. Field of the Invention

This invention relates to adjustable light fixtures and means for suspending light fixtures.

2. Description of the Prior Art

The display industry, particularly display personnel for department stores, has been seeking a single light fixture which is adjustable both to give general illumination and to direct light at an object at a variety of angles. Thus, the desired single fixture could be used to light a general overall area or could be used as an accent light. In the past when directing light toward an object to emphasize various features of that object, it has often been necessary to move the object with respect to the light since the fixture was not quickly and easily adjustable. In addition, many times two different light fixtures were required to provide general illumination in addition to an accent light. At least three United States patents have been granted for light fixtures. They are: U.S. Pat. No. 2,855,503 to Gerstel, U.S. Pat. No. 3,263,072 to Kruger and U.S. Pat. No. 3,381,123 to Docimo.

From the above background, it can be seen that there has been a need for a light fixture which could be quickly and easily adjusted to light a general area and to direct light at an object at various angles. The fixture should be adjustable in the vertical direction. In addition, the light should be rotatable about a vertical axis and pivotable about a horizontal axis. The light should be adjustable both when it is recessed in the ceiling and when it is extended from the ceiling. The suspension means for the light should be equally adaptable to incandescent and mercury lighting elements. This basic need has been partially satisfied by the adjustable light fixture shown and described by U.S. Pat. No. 3,660,651 to Miles (1972). However, additional problems have arisen, specifically, with regard to the use of mercury lights. Mercury lights are characteristically heavier than the incandescent light for which the adjustable light fixture of U.S. Pat. No. 3,660,651 was designed. In addition, mercury lights have a high rate of heat dissemination relative to incandescent lights and in addition have a violent termination of life often accompanied by a cracking or disintegration of the lighting elements. Therefore, in addition to the generally increased weight due to the mercury lighting element it has been found desirable to add a glass lens to the lighting fixture to prevent heat loss from the light fixture and to prevent glass from accidentally being discharged during a particularly violent termination of a mercury lighting element. The result of the use of mercury lighting element and the addition of a lens has been a general increase in the weight of the suspended unit. Therefore the toggle arm arrangement described by U.S. Pat. No. 3,660,651 has not proven satisfactory for the increased weight.

SUMMARY OF THE INVENTION

This invention relates to a display light fixture assembly for recessed mounting in a wall or ceiling with the assembly comprising a tubular housing having a mounting flange at one of its ends. The mounting flange is adapted to mount the housing end substantially flush with a wall or ceiling surface with the body of the housing extending inwardly from the wall or ceiling surface.

A beam directing reflector is disposed in telescoping relation within the housing with the reflector spaced from the inner surface of the housing wall. A yoke is provided to support the reflector for angular adjustment within the housing about an axis normal to the longitudinal axis of the tubular housing. In addition, extensible mounting means for the reflector, permitting its withdrawal from within the housing, include two sets of extensible toggle arm members extending within the housing in spaced relation and having the corresponding lever ends pivotally supported by a first pair of bracket members. The first pair of bracket members are fixedly attached to a collar and the collar is rotatably mounted to the inside surface of the housing with the collar being rotatable through approximately 355°. A second bracket member extends between, and is pivotally joined to, the corresponding spaced lever ends remote from the pivotally supported lever ends. A single fastening member centrally joins the reflector supporting yoke and the second bracket member permitting the reflector to swivel with relation to the seond bracket and the toggle arms. In addition, it permits the reflector to be angularly tilted with relation to the supporting yoke both when the toggle arms are retracted so that the reflector is within the housing and when the toggle arms are extended so that the reflector extends outside the housing.

One object of the present invention is to provide a light fixture which may be quickly and easily adjusted for directing light at various angles and for providing general illumination. The light fixture is adjustable both when it is recessed in the ceiling and when it is extended from the ceiling.

An additional object of this invention is to provide a light fixture which can support the heavier elements necessary for use in combination with a mercury light in addition to the traditional incandescent light.

Related objects and advantages will be apparent from the following description.

DESCRIPTION OF THE PREFERRED EMBODIMENT

Figure 1:
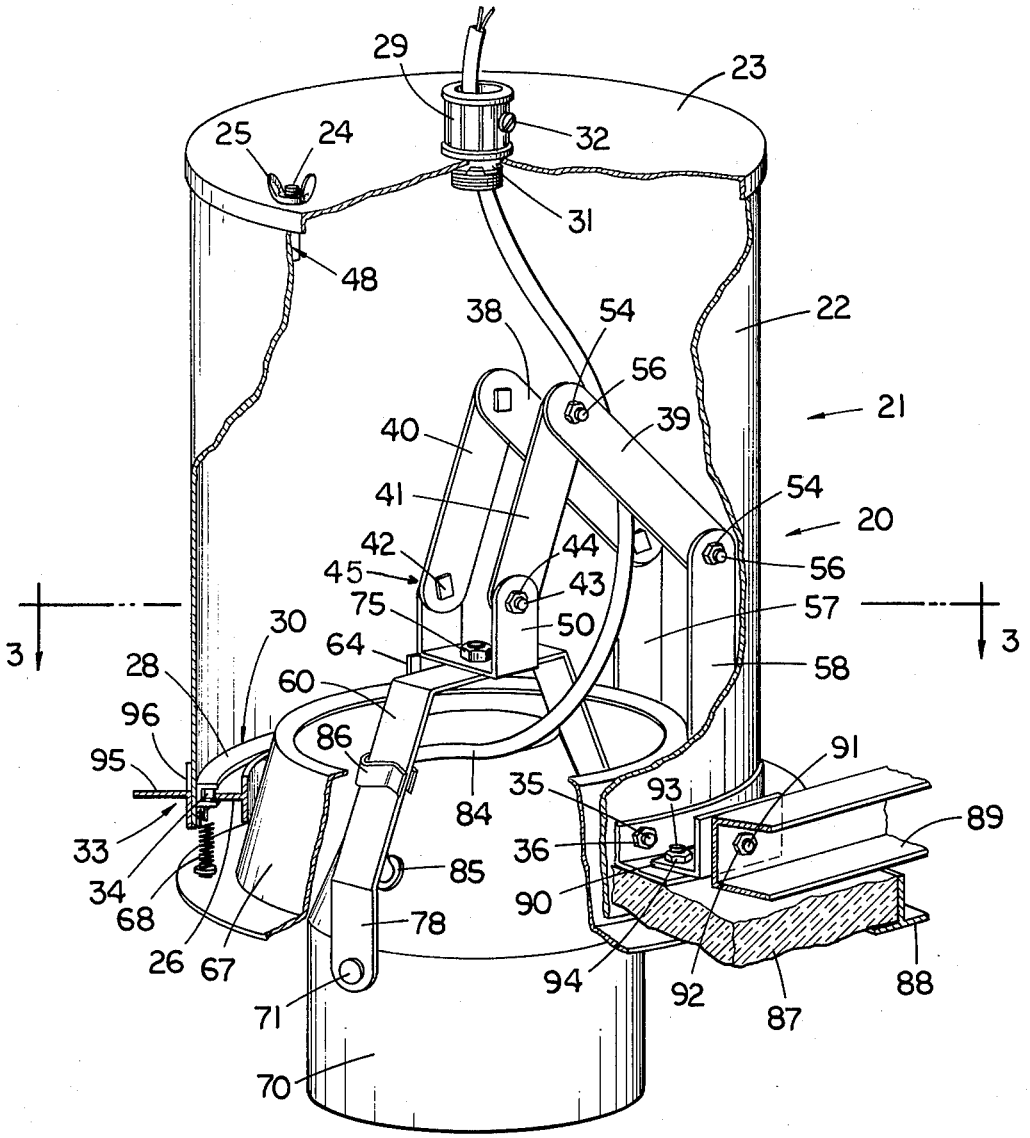
FIG. 1 is a fragmentary perspective view of an adjustable light fixture incorporating the present invention.
Figure 2:
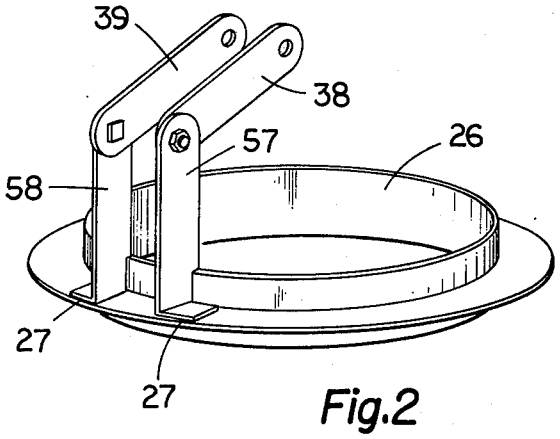
FIG. 2 is a perspective view of the collar and a portion of the toggle arm support structure of an adjustable light fixture incorporating the present invention.

For the purposes of promoting an understanding of the principles of the invention, reference will now be made to the embodiment illustrated in the drawings and specific language will be used to describe the same.

It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a fragmentary perspective view of an adjustable light fixture 20 having an electric light bulb mounted within beam directing reflector or shade 70 which is suspended by arms within housing 21 mounted to a ceiling. Shade 70 may be swiveled and moved vertically. In addition, shade 70 may be pivoted about its horizontal mounting axis allowing for different lighting techniques.

Figure 3:
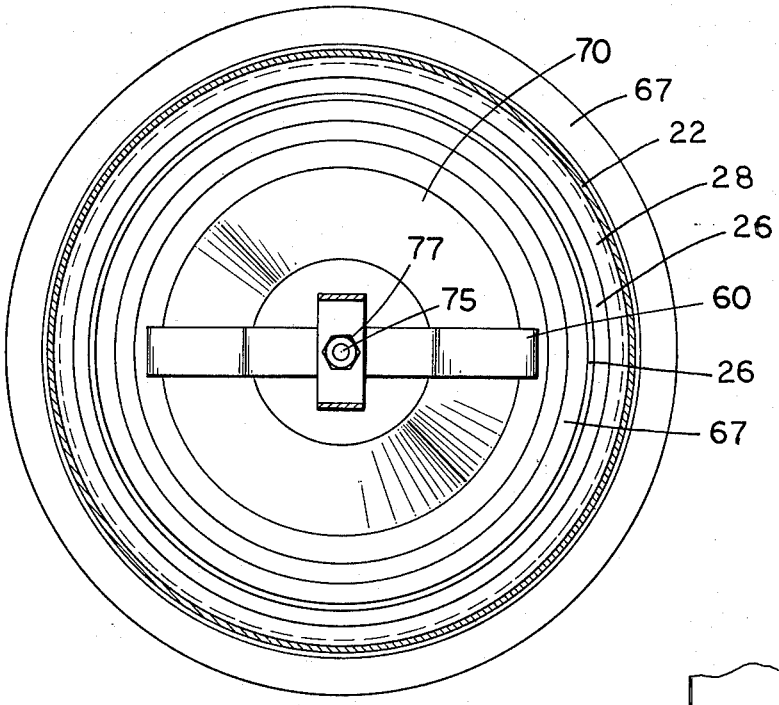
FIG. 3 is a top view in section of an adjustable light fixture incorporating the present invention taken along line 3—3 of FIG. 1 and viewed in the direction of the arrows.
Figure 5:
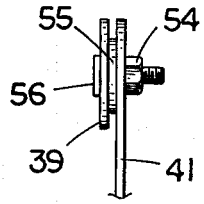
FIG. 5 is an enlarged fragmentary view taken along line 5—5 in FIG. 1 and viewed in the direction of the arrows of an arm connection.

Housing 21 has a side wall 22 enclosing the arms and shade 70 and is covered on the top by wall 23. Threaded rods 24 have flat bottom ends fastened to sidewalls 22 by welds 48. The top threaded ends of rods 24 pass through top wall 23 with wing nut 25 threaded thereon securing the top wall 23 to the side wall 22. The ends of the toggle arms 38 and 39 support the light shade 70 and are rotatably mounted to mounting brackets 57 and 58 which are fixedly fastened to collar 26 by welds 27. Arm 39 has its bottom end rotatably mounted to bracket 58 by nut 54, washer 55 and bolt 56. Likewise, arm 38 has its bottom end rotatably mounted to bracket 57 by a nut, washer and bolt. Rotatably mounted to the top end of arm 39 is the top end of arm 41. Likewise, rotatably mounted to the top end of arm 38 is the top end of arm 40. Fig. 3 is a fragmentary view taken along the line 3—3 and viewed in the direction of the arrows of FIG. 1. FIG. 5 shows the top end of arm 41 mounted to the top end of arm 39 by bolt 56 passing through the two arms and secured by nut 54. A flat washer 55 is located between the two arms allowing the two arms to rotate about the axis of the bolt. The mounting arrangement shown in FIG. 5 is identical with the mounting arrangement used to mount the top end of arm 38 to the top end of arm 40. Likewise, the same mounting arrangement is used to mount the bottom end of arm 38 to brakcet 57 and the bottom end of arm 39 to bracket 58.

Collar 26 is rotatable in a U-shaped track 28 which is attached to the inside of wall 22 of housing 21. Track 28 is attached to wall 22 by weld 30. Stop means 34 are attached to track 28 to prevent rotation of collar 26 through more than 355 degrees.

Rotatably mounted to the bottom of toggle arms 40 and 41 is U-shaped bracket 50 which in turn is mounted to a yoke or shade handle 60 for supporting shade 70. The lower end of arm 41 is rotatably mounted to one of the top ends of U-shaped bracket 50 by bolt 43 and nut 44. Likewise, the lower end of arm 40 is rotatably mounted to the top end of U-shaped bracket 50 by bolt 42 and nut 45. Shade handle 60 has a generally inverted U-shaped configuration with its top middle portion rotatably mounted by bolt 75, nut washer 76 and hex nut 77 to the horizontal portion of U-shaped bracket 50. Rotatably mounted to the lower ends of shade handle 60 is the light shade 70. Bolt 71 freely passes through arm 78 of shade handle 60 and through the side wall of shade 70 and is secured thereon by hex nut 74. A lock washer 72 is located between arm 78 and shade 70 and lock washer 73 is located between hex nut 74 and shade 70 thereby allowing shade 70 to rotate about the axis of bolts 71.

Arm 79 of shade handle 60 is likewise rotatably mounted by a bolt lock washers, and nut for the opposite side of shade 70.

Figure 4:
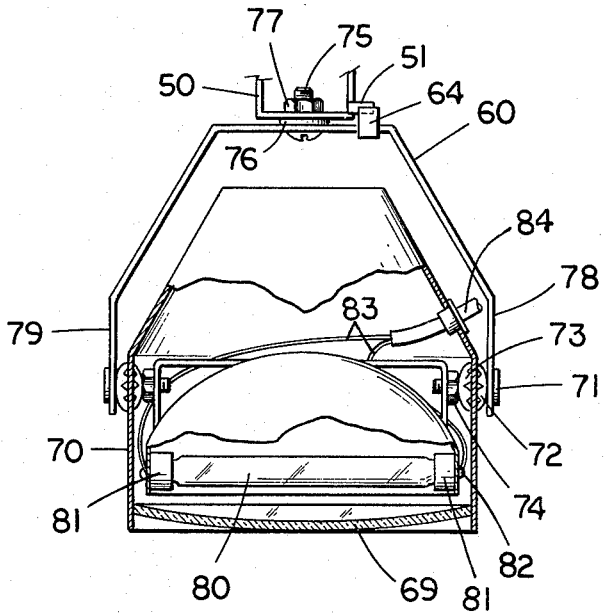
FIG. 4 is a fragmentary view of the light shade and associated structure of the adjustable light fixture shown in FIG. 1.

Shade 70 is cup-shaped having its open end at the bottom allowing the light from bulb 80 to shine out. Preferably, a lens 69 is inserted in the open end of shade 70 to prevent heat from being emitted from the bulb 80 and to prevent the dispersal of glass should the bulb 80 have a particularly violent termination of life. As is shown in FIG. 4, bulb 80 is received into sockets 81 which are fastened to the side walls of shade 70. Sockets 81 are conventional in nature and are fastened to the side wall of shade 70 by screws 82. Wires 83 exit socket 81 covered by insulation 84 passing through the side wall of shade 70. A snap bushing 85 is secured to the side wall of shade 70 allowing the insulated wire to exit therethrough. Wires 83 then connect the sockets 81 with the source of electrical energy passing through connector 29. Connector 29 is secured to wall 23 by nut 31 threaded onto the bottom end of connector 29. Screw 32 is provided on connector 29 having a blunt end for securing the wires passing through the hollow center of connector 29.

It can be appreciated that wires 83 may become tangled between the various arms suspending shade 70 as the shade is moved vertically, swiveled or pivoted. Therefore, the present adjustable light fixture 20 incorporates several features precluding injury to wires 83 including stop means 34 in track 28. Also, a standard cable clip 86 (FIG. 1) secures the insulated wires 83, to arm 78 of shade handle 60. Similar clips may be employed by other arms securing the cable thereto. As shade 70 is swiveled or rotated about the vertical axis, the insulated wires will become twisted around the arms if the rotation of the shade is not limited. Therefore, means have been provided on the arms to limit the amount of rotation. Referring to FIG. 1, flange 64 extending upward is welded to the horizontal portion of shade handle 60 in such manner so as to abut against the horizontally extending flange 51 welded to one of the vertical arms of U-shaped handle 50. Thus, shade handle 60 may be rotated one complete revolution about the longitudinal axis of bolt 75. Further revolution in the same direction is prevented when flange 64 abuts against flange 51.

Figure 6:
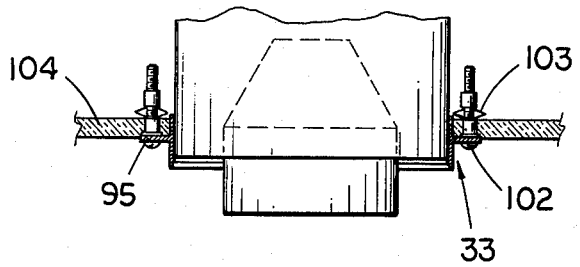
FIG. 6 is a fragmentary view of the adjustable light fixture of FIG. 1 shown mounted to a plaster ceiling.

Adjustable light fixture 20 can be mounted to a suspended ceiling or to a plaster ceiling. FIG. 1 illustrated the mounting of the adjustable light fixture to a suspended ceiling. Fastened to the outside housing 21 is a standard mounting frame 33. Mounting frame 33 is secured to the lower portion of side wall 22 by screw 35 and nut 36. Mounting frame 33 has a horizontal wall 95 extending around wall 22 and is integrally attached to a vertical wall 96 also extending around housing 21. Mounted within housing 21 is trim member 67 which extends out the bottom opening of housing 21 abuttingly engaging the lower portion of frame 33. Trim member 67 has a hole in its center for allowing shade 70 to be pulled through. Trim member 67 is mounted to the inside of wall 22 by three 1 inch coiled springs 68 spaced at 120 degree intervals around the inside circumference of wall 22. Thus, the distance between horizontal wall 95 of mounting frame 33 to horizontal wall 101 of trim member 67 may be adjusted in accordance with the thickness of ceiling tile 87 by extending the trim member 67 and the coil springs 68. The tile 87 in the suspended ceiling are generally supported by inverted T-shaped bars 88 having horizontal flanges supporting the lower surface of the ceiling tile. Mounted perpendicular to the top of bars 88 are C-shaped bars 89. A right angle bracket 90 is used to mount horizontal wall 95 to the vertical wall of bar 89. Screws 93 and nut 94 are used to securely fasten horizontal wall 95 to right angle bracket 90 and screw 91 and nut 92 are used to secure bracket 90 to bar 89. Thus, adjustable light fixture 20 may be readily mounted to a suspended ceiling. Likewise, the adjustable light fixture may be mounted to the traditional plaster ceiling by disengaging springs 68 from wall 22 and removing trim member 67 from the light fixture. The light fixture is then inserted into a hole in the plaster ceiling as shown in FIG. 6 and screws 102 and wing nuts 103 are used to secure horizontal wall 95 of mounting frame 33 to plaster ceiling 104.

Figure 7:
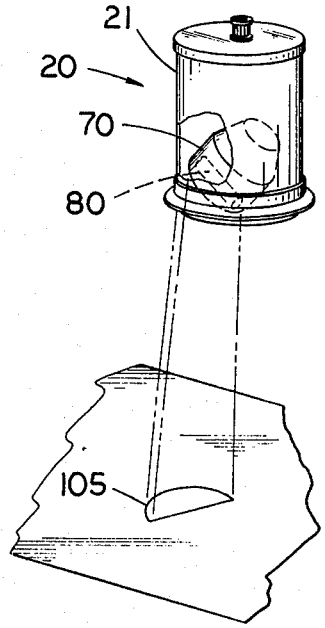
FIG. 7 is a fragmentary view of the adjustable light fixture of FIG. 1 with the shade pivoted to create a "half moon" light.

It will be evident from the above description that the adjustable light fixture allows the shade and light bulb to be adjusted vertically in the extreme upward and downward positions or in any intermediate position. Thus, the light fixture may be adjusted in the "recessed position" as generally shown in FIG. 7 of the "extended position" as generally shown in FIG. 1. Likewise, the light fixture may be adjusted at any intermediate location. In one embodiment of the light fixture, shade 70 was extendable one foot from the fully recessed position and was adjustable along the entire one foot distance. It will be further evident that the shade and light bulb may be swiveled or rotated about a vertical axis 360° and may be pivoted 180° about a horizontal axis in addition to the entire assembly of toggle arms, shade and light bulb being rotatable about a vertical axis for 355°. It is also possible to create a half moon lighting effect 105 by positioning shade 70 within housng 21 as shown in FIG. 7 and by pivoting the shade in such a manner so that a portion of the light emitted from bulb 80 is blocked by the structure of the fixture. It will also be evident from the above description that the light bulb and shade may be extended from the housing to provide general illumination.

While the invention has been illustrated and describe in detail in the drawings and foregoing description, the same is to be considered as illustrative and not restrictive in character, it being understood that only the preferred embodiment has been shown and described and that all changes and modifications that come within the spirit of the invention and the scope of the claims is also desired to be protected.

What is claimed is:

1. A display lighting fixture assembly for recessed mounting in a wall or ceiling, said assembly comprising:

a. a tubular housing having a mounting flange at one of its ends adapted to mount said housing end substantially flush with a wall or ceiling surface with the body of the housing extending inwardly from said surface;

b. a beam directing reflector disposed in telescoping relation within said housing with the reflector spaced from the inner surface of the housing wall;

c. a yoke supporting said reflector for angular adjustment within said housing about an axis normal to the longitudinal axis of said tubular housing; and d. extensible mounting means for the reflector permitting its withdrawal from within the housing, said mounting means comprising:

i. two sets of extensible toggle levers extending within said housing in spaced relation and having the corresponding lever ends pivotally supported by a first pair of bracket members, said first pair of bracket members being fixedly attached to a collar, said collar being rotatably mounted to the inside surface of said housing, said collar being rotatable through approximately 355°;

ii. a second bracket member extending between and pivotally joined to the corresponding spaced lever ends remote from said pivotally supported lever ends;

iii. a single fastening member centrally joining said reflector supporting yoke and said second bracket member thereby permitting said reflector to swivel with relation to said second bracket and said toggle levers and to be angularly tilted with relation to said supporting yoke both when said toggle levers are retracted so that said reflector is within said housing and when said toggle levers are extended so that said reflector extends outside said housing.

2. The display lighting assembly as claimed in claim 1 further comprising a trim member masking the end of said housing adjacent said reflector and attachment means connecting said housing and said trim member.

3. The display lighting assembly as claimed in claim 1 further comprising lens means disposed in said beam-directing reflector.

4. The display lighting fixture assembly as claimed in claim 1 in which said yoke carries a stop cooperating with said second bracket member to limit swivel motion of said reflector to a single rotation of approximately 360°.

5. The display lighting fixture assembly as claimed in claim 1 in which said housing includes a stop cooperating with said collar to limit rotation of said collar to approximately 355°.

* * * * *